US006352243B1

(12) United States Patent
Samejima

(10) Patent No.: US 6,352,243 B1
(45) Date of Patent: Mar. 5, 2002

(54) CHAIN HOIST WITH OVERLOAD PREVENT DEVICE

(75) Inventor: Yasuhiro Samejima, Osaka (JP)

(73) Assignee: Vital Kogyo Kabushiki Kaisha, Osaka (JP)

( * ) Notice: Subject to any disclaimer, the term of this patent is extended or adjusted under 35 U.S.C. 154(b) by 0 days.

(21) Appl. No.: 09/563,993

(22) Filed: May 3, 2000

(30) Foreign Application Priority Data

Jun. 7, 1999 (JP) ..... 11-160090

(51) Int. Cl.[7] ..... B66D 1/14
(52) U.S. Cl. ..... 254/352; 254/346; 464/38
(58) Field of Search ..... 254/346, 352; 464/38

(56) References Cited

U.S. PATENT DOCUMENTS 1,281,507 A * 10/1918 Burks ..... 464/38
2,353,562 A * 7/1944 Hatcher ..... 254/346
3,596,446 A * 8/1971 Bryan ..... 464/38
3,967,711 A * 7/1976 Stroezel et al. ..... 464/38
4,062,203 A * 12/1977 Leonard et al. ..... 464/38
4,605,111 A * 8/1986 Ohno et al. ..... 254/346
4,664,357 A * 5/1987 Nishimura ..... 254/903
4,690,379 A * 9/1987 Nakamura ..... 254/903
5,110,003 A * 5/1992 MacWilliams ..... 464/38
5,314,288 A * 5/1994 Schmidt ..... 254/903
6,224,039 B1 * 5/2001 Okamoto et al. ..... 254/352

* cited by examiner

*Primary Examiner*—Katherine A. Matecki
(74) *Attorney, Agent, or Firm*—Vedder Price Kaufman & Kammolze

(57) ABSTRACT

The object is to provide a chain hoist with an overload prevent device, ensuring an easy and secure adjustment of load limit numerical values. It comprises a pressing drive member 8 for pressing and rotating a pressure receive member 7 by way of a backstop wheel 11 and friction members 9 and 10, and an axially displaceable, rotary drive member 14 adapted to transmit a rotational force of a hand chain wheel 15 to the pressing drive member. The rotary drive member is urged toward the pressing drive member by a belleville spring 24. The pressing drive member and the rotary drive member have lock teeth 80 and 140 that are formed on their respective confronting faces. The lock teeth 80 and 140 include steeply sloped wind-down press faces 80*a* and 140*a*, respectively, and gently sloped wind-up press faces 80*b* and 140*b*, respectively. A rotation limit member intervenes between the rotary drive member 14 and the belleville spring 24 in order to prevent a rotational force of the rotary drive member from being transmitted to the belleville spring and a nut 25 even though the rotary drive member is rotated while climbing over the gently sloped faces in an overload condition.

2 Claims, 5 Drawing Sheets

CHAIN HOIST WITH OVERLOAD PREVENT DEVICE

BACKGROUND OF THE INVENTION

1. Field of the Invention

The present invention relates generally to a hoisting apparatus such as a chain block, and more particularly to a chain hoist with an overload prevent device.

2. Description of the Related Art

In a known hoisting apparatus, a rotational drive force induced by, e.g., a hand chain wheel is transmitted to a pressing drive member that is screwed on a driving shaft in a manner capable of advance and retreat, and a pressure receive member firmly secured to the driving shaft is pressed for rotation by the pressing drive member by way of a backstop wheel and a pair of friction members arranged on opposed sides of the backstop wheel.

A typical overload prevent device for use with such a hoisting apparatus has hitherto been constructed such that friction forces are utilized to cause sliding motions to occur between the members in case of possible suspension of an overload, to thereby prevent the rotational force induced by, e.g., the hand chain wheel from being transmitted to the pressing drive member.

In the conventional construction, e.g., a friction plate version, the pressing force adjustment for the setting of limit load was time-consuming due to the necessity to adjust the pressing force on the friction plates. Furthermore, the wear of the friction plates was inevitable and the limit load might possibly vary even in case of a small amount of wear with use. To obviate this, the pressing force had to be adjusted in an appropriate fashion.

SUMMARY OF THE INVENTION

The present invention was conceived in view of the above circumstances. It is therefore a major object of the present invention to provide a chain hoist with an overload prevent device, ensuring an easy setting of a maximum lifting load. Another object of the present invention is to provide a chain hoist free from risk of variation of the limit load in use in an overload condition.

In order to solve the above problems, according to a first aspect of the present invention there is provided a chain hoist comprising a drive shaft transmitting a rotational force to a load sheave; a pressure receive member firmly secured to the drive member; a backstop wheel rotating in one direction only relative to the drive shaft; a pressing drive member adapted to be screwed on the drive shaft in a manner allowing its advance and retreat, with the backstop wheel being sandwiched between the pressing drive member and the pressure receive member; a large-diameter boss projecting from the pressing drive member in the direction toward the axial fore-end; a small-diameter boss projecting from the large-diameter boss in the direction toward the axial fore-end, the small-diameter boss having threaded grooves formed in its peripheral surface; a rotary drive member adapted to be fitted rotatably around the large-diameter boss of the pressing drive member, the rotary drive member facing the pressing drive member in the axial direction; a plurality of, circumferentially extending lock teeth having a substantially triangular section, the lock teeth being formed on confronting faces of the pressing drive member and the rotary drive member, the lock teeth confronting each other being engaged with each other; a gently sloped face constituting each of the lock teeth, the gently sloped faces confronting each other being pressed against each other when the rotary drive member is rotated relative to the pressing drive member in the winding up direction; a steeply sloped face constituting each of the lock teeth, the steeply sloped faces confronting each other being pressed against each other when the rotary drive member is rotated relative to the pressing drive member in the winding down direction; a first engaging portion formed on the outer periphery of the rotary drive member; a driving wheel adapted to be fitted around the outer periphery of the rotary drive member, the driving wheel having a first engaged portion meshing with the first engaging portion of the rotary drive member; a second engaging portion formed on a protrusion of the large-diameter boss that protrudes from the rotary drive member in the direction toward the fore-end when the rotary drive member is fitted around the large-diameter boss; a rotation limit member having a larger external diameter than the internal diameter of the driving wheel, the outer peripheral edge of the rotation limit member serving as a restricting portion for restricting a displacement of the driving wheel in the direction toward the axial fore-end, the ration limit member having on its inner periphery a second engaged portion that is engaged with the second engaging portion at the fore-end of the large-diameter boss; biasing means adapted to be fitted around the small-diameter boss at a position closer to the axial fore-end than the rotation limit member, the biasing means providing a biasing force insufficient to cause the lock teeth of the rotary drive member to climb over the steeply sloped faces of the lock teeth of the pressing drive member when the rotary drive member is rotated in the wind-down direction upon the winding down operation, the biasing means providing a biasing force sufficient to cause the lock teeth of the rotary drive member to climb over the gently sloped faces of the lock teeth of the pressing drive member when an overload is applied to the rotary drive member upon the winding up operation; and a nut adapted to be screwed onto the small-diameter boss, for positioning the biasing means relative to the pressing drive member.

According to a second aspect of the present invention there is provided a chain hoist comprising a drive shaft transmitting a rotational force to a load sheave; a pressure receive member firmly secured to the drive member; a backstop wheel rotating in one direction only relative to the drive shaft; a pressing drive member adapted to be screwed on the drive shaft in a manner allowing its advance and retreat, with the backstop wheel being sandwiched between the pressing drive member and the pressure receive member; a large-diameter boss projecting from the pressing drive member in the direction toward the axial fore-end; a small-diameter boss projecting from the large-diameter boss in the direction toward the axial fore-end, the small-diameter boss having threaded grooves formed in its peripheral surface; a rotary drive member adapted to be fitted rotatably around the large-diameter boss of the pressing drive member; a lock teeth formation member adapted to be fitted around the large-diameter boss of the pressing drive member at a position facing the surface, toward the axial fore-end, of the rotary drive member, the lock teeth formation member being mounted thereon in an axially movable but rotationally prohibited manner; a plurality of, circumferentially extending lock teeth having a substantially triangular section, the lock teeth being formed on confronting faces of the lock teeth formation member and the rotary drive member, the lock teeth confronting each other being engaged with each other; a gently sloped face constituting each of the lock teeth, the gently sloped faces confronting each other being pressed against each other when the rotary drive member is rotated relative to the lock teeth formation member in the winding up direction; a steeply sloped face constituting each of the lock teeth, the steeply sloped faces confronting each other being pressed against each other when the rotary drive member is rotated relative to the lock teeth formation member in the winding down direction; an engagement portion formed on the outer periphery of the rotary drive member; a driving wheel adapted to be fitted around the outer periphery of the rotary drive member, the driving wheel being engaged between the engagement portion and the pressing drive member so as to restrict a displacement relative to the rotary drive member both in the direction toward the axial fore-end and in the circumferential direction; biasing means having a larger external diameter than the internal diameter of the lock teeth formation member, the outer peripheral edge of the biasing means acting as a restricting portion for restricting a displacement of the lock teeth formation member in the direction toward the axial fore-end, the biasing member being fitted around the small-diameter boss at a position closer to the axial fore-end, the biasing means providing a biasing force insufficient to cause the lock teeth of the rotary drive member to climb over the steeply sloped faces of the lock teeth of the lock teeth formation member when the rotary drive member is rotated in the wind-down direction upon the winding down operation, the biasing means providing a biasing force sufficient to cause the lock teeth of the rotary drive member to climb over the gently sloped faces of the lock teeth of the lock teeth formation member when an overload is applied to the rotary drive member upon the winding up operation; and a nut adapted to be screwed onto the small-diameter boss, for positioning the biasing means relative to the pressing drive member.

The chain hoist with an overload prevent device of the present invention ensures an easy adjustment of the limit load to improve the adjusting efficiency. In the event that a try to lift the load is made in an overload condition, a warning is provided in the form of noise that can be produced upon idle of the lock teeth. In addition, if the overload condition takes place, an easy lowering operation is ensured.

Moreover, when the rotary drive member is rotated in the lifting direction in the overload condition, the rotary drive member rotates while compressively deforming the biasing member and thus subjects the biasing member and the nut to a large urging force. However, by virtue of the rotation limit member intervening between the rotary drive member and the belleville spring, and by virtue of the engagement of the engaging portion of the rotation limit member with the engaged portion of the pressing drive member, the rotational force of the rotary drive member applied to the pressing drive member is by no means transmitted to the biasing member and the nut. This prevents the nut from tightening or loosening in case of rotation of the rotary drive member in the overload condition and thereby eliminates a fear that the set limit load may vary.

The above and other objects, aspects, features and advantages of the present invention will become more apparent from the following detailed description when read in conjunction with the accompanying drawings in which the same or like parts are designated by the same or corresponding reference numerals throughout several views.

DETAILED DESCRIPTION OF THE PREFERRED EMBODIMENTS

A chain hoist of the present invention will now be described in greater detail.

Figure 1:
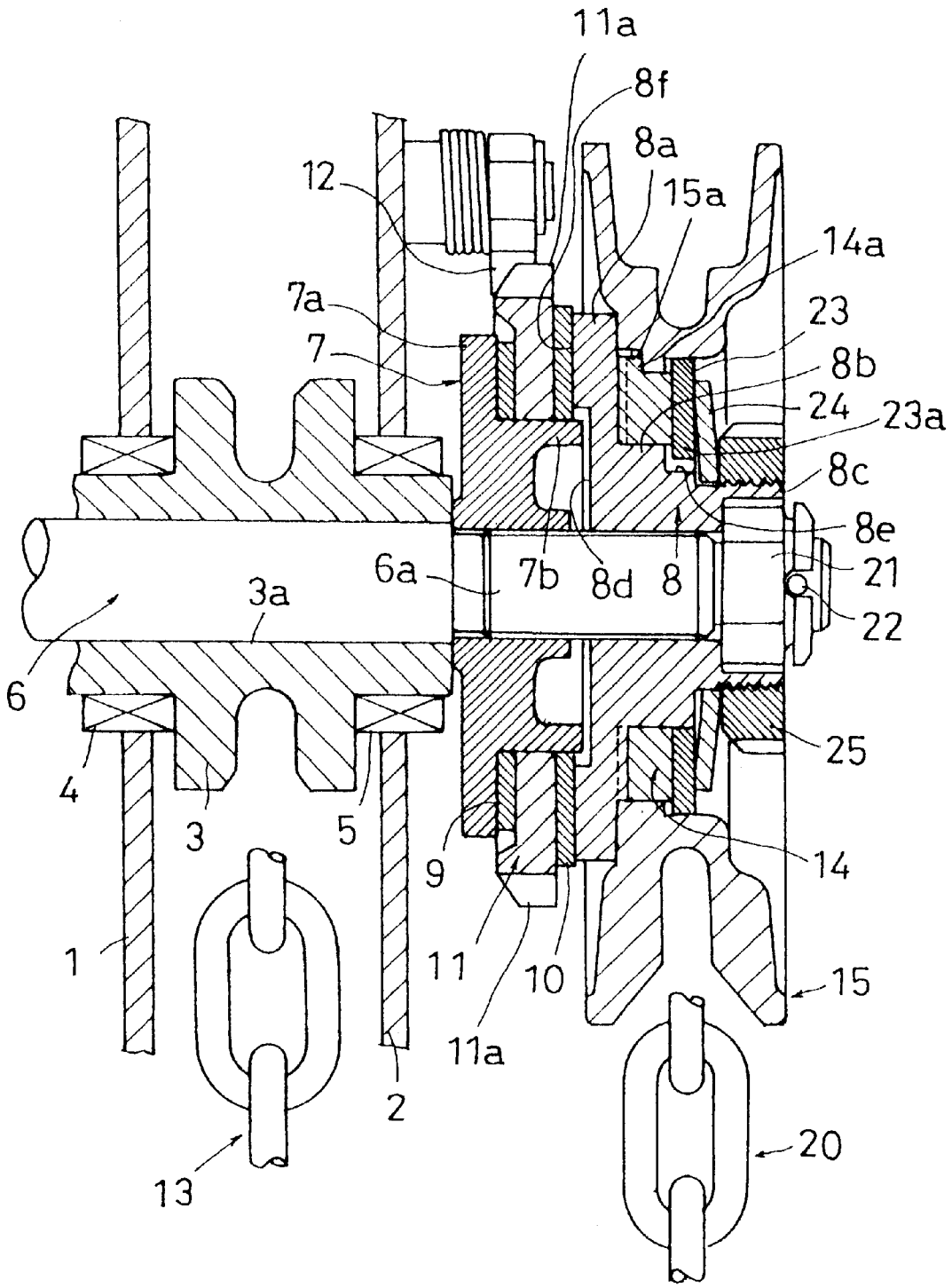
FIG. 1 is a sectional view showing a first embodiment of a chain hoist with an overload prevent device in accordance with the present invention.
Figure 2:
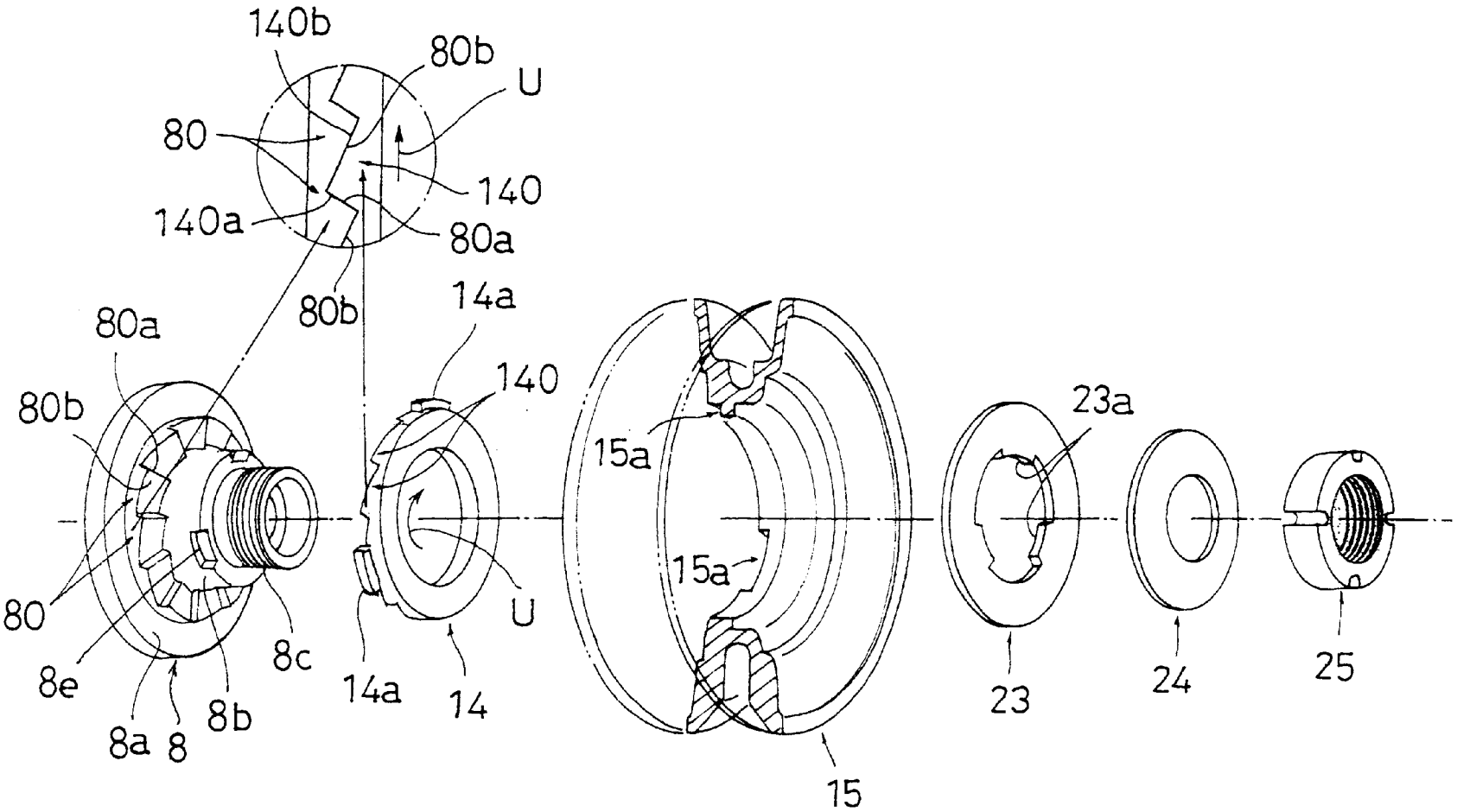
FIG. 2 is an exploded perspective view showing the principal part of the overload prevent device of the chain hoist of the first embodiment shown in FIG. 1.

FIG. 1 is a sectional view of the chain hoist in accordance with a first embodiment of the present invention. FIG. 2 is an exploded perspective view of the major part of an overload prevent device of the chain hoist in accordance with this embodiment.

The chain hoist of the first embodiment illustrated in FIGS. 1 and 2 is in the form of a chain block, namely a manually operated chain hoist, provided with a hand chain wheel.

In FIG. 1 a load chain wheel, namely a load sheave 3 is disposed between a pair of side plates 1 and 2 that are retained in parallel relationship with a certain spacing. The load sheave 3 is rotatably held by a pair of bearings 4 and 5 that are supported on the side plates 1 and 2, respectively. The load sheave 3 has at its center a shaft hole 3*a* extending therethrough that rotationally receives a drive shaft 6. Both ends of the drive shaft 6 protrude from the right and left ends of the load sheave 3.

The left-hand protrusion of the drive shaft 6 is connected via a speed reducing gear transmission train not shown to the load sheave 3. On the other hand, the right-hand protrusion is formed with a first threaded portion 6*a* that carries means for driving the load sheave 3. More specifically, onto the first threaded portion 6*a* of the drive shaft 6 there are threaded a pressure receive member 7 and a pressing drive member 8 in order of vicinity to the side plate 2, with the pressure receive member 7 being fully screwed until it reaches the innermost part of the first threaded portion 6*a* to be rigidly fastened to the drive shaft 6.

The pressure receive member 7 has concentrically a large-diameter disk portion 7*a* and a small-diameter boss 7*b*. The disk portion 7*a* is in close vicinity to the side plate 2 and the boss 7*b* projects from the central part of the disk portion 7*a* axially toward the fore-end (rightward in FIG. 1). A backstop wheel 11 is externally fitted around the boss 7*b* of the pressure receive member 7, with the wheel 11 being sandwiched by a pair of friction members 9 and 10. Arrangement is such that the backstop wheel 11 and the friction members 9, 10 sandwiching the wheel 11 therebetween are allowed to be pressed by the pressing drive member 8 against the disk portion 7*a* of the pressure receive member 7.

Around its periphery the backstop wheel 11 is provided with lock teeth 11*a* that are sloped toward one circumferential direction. The engagement of the lock teeth 11*a* with a ratchet pawl 12 hinged to the side plate 2 prevents any reverse rotations of the backstop 11 so that it can rotate in one direction only, i.e., in the hoisting direction only, relative to the drive shaft 6.

When the pressing drive member 8 rotates in the hoisting direction relative to the drive shaft 6, it is displaced along the drive shaft 6 toward the axial base end (leftward in FIG. 1) so as to press the friction members 9, 10 and the backstop wheel 11 against the disk portion 7*a* of the pressure receive member 7, for integral rotation with the pressure receive member 7. As a result, rotations of the pressing drive member 8 are transmitted via the pressure receive member 7, drive shaft 6 and speed reducing gear transmission train to the load sheave 3, allowing a load suspended by a link chain 13 passed around the load sheave 3 to be hoisted.

Toward the pressure receive member 7, i.e., toward the axial base end, the pressing drive member 8 is provided with a flange 8*a* having an annular pressing surface 8*f*. The pressing drive member 8 is further provided with a large-diameter boss 8*b* located centrally of the flange 8*a* and projecting toward the axial fore-end, and with a small-diameter boss 8*c* projecting from the large-diameter boss 8*b* toward the fore-end. Toward the axial base end, the pressing drive member 8 is formed with an insertion recess 8*d* located centrally of the flange 8*a*, for receiving the axial fore-end of the boss 7*b* of the pressure receive member 7 to a slight extent, as seen in FIG. 1. The insertion recess 8*d* has a diameter slightly larger than the external diameter of the boss 7*b* of the pressure receive member 7 so as to prevent any direct contact of the boss 7*b* of the pressure receive member 7 with the pressing drive member 8. The annular pressing surface 8*e* of the flange 8*a* of the pressing drive member 8 is able to abut against the friction member 10.

Lock teeth 80 are formed on the axial fore-end surface of the flange 8*a* of the pressing drive member 8, at the annular face outside the large-diameter boss 8*b*. The lock teeth 80 have the same geometry and are formed in a circumferentially iterative manner.

Figure 3:
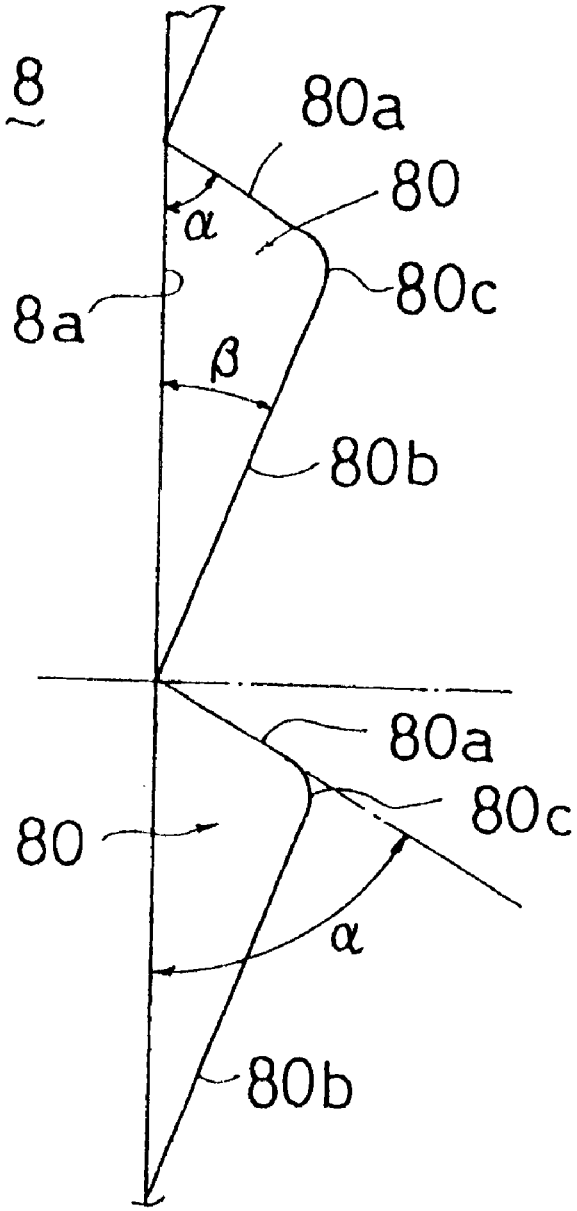
FIG. 3 is a sectional view showing lock teeth of a pressing drive member shown in FIG. 2.

The lock teeth 80 of the pressing drive member 8 are each of a generally triangular section and protrude toward the axial fore-end, as illustrated in FIGS. 2 and 3.

More specifically, each lock tooth 80 includes a face 80*a* that is pressed upon the winding down (hereinafter referred to as a wind-down press face) in the form of a steeply sloped face. The steeply sloped face can be a substantially perpendicular face that is raised substantially perpendicular to the axial fore-end surface of the flange 8*a* and that extends toward the axial fore-end, or a sloped face having a large rise angle relative to the fore-end surface of the flange 8*a*. The angle of slope is determined so as to provide a sloped face that slants toward the wind-down direction, at the rise angle $\alpha$, e.g., of the order of 90 to 45 degrees, preferably about 70 to 50 degrees (approx. 60 degrees in the shown example), relative to the axial fore-end surface of the flange 8*a* of the pressing drive member 8. The steeply sloped face helps to prohibit the lock teeth from being climbed over when a rotary drive member which will be described later rotates in the wind-down direction. In cases where the wind-down press face 80*a* is in the form of the sloped face slightly slanting relative to the axis instead of the substantially perpendicular face extending in the axial direction as in the shown example, it is possible to suppress the magnitude of warnings which will be described later to a moderate level.

A face 80*b* pressed upon the winding up of the lock teeth (hereinafter referred to as a wind-up press face) is fashioned into a gently sloped face. The wind-up press face 80*b* has the angle of slope $\beta$ of the order of 10 to 30 degrees (approx. 20 degrees in the shown example) relative to the axial fore-end surface of the flange 8*a* of the pressing drive member 8. Thus, the slope of the face 80*b* relative to the axial fore-end surface of the flange 8*a* is sufficiently smaller than that of the wind-down press face 80*a*. The angle of the gently sloped face is determined such that when any overload is applied to the rotary drive member upon the winding up, the gently sloped face of the lock tooth can be climbed over against a biasing force imparted by biasing means.

The apex of the lock tooth 80, i.e., an intersection 80*c* between the wind-down press face 80*a* and the wind-up press face 80*b* is chamfered into an arc as illustrated in FIG. 3. In FIG. 2 the arrow U indicates the wind-up direction. The root formed between the adjacent lock teeth 80 is of substantially the same, but inverted, contour as that of the lock tooth 80.

A nut 21 is screwed onto the axial fore-end of the drive shaft 6, with a stop pin 22 inserted into the drive shaft 6 for preventing the occurrence of any looseness. The nut 21 serves to block any excess displacement of the pressing drive member 8 toward the axial fore-end. It is to be noted that the nut 21 is partially received in a recessed portion formed in the end face of the axial fore-end as seen in FIG. 1.

The boss portion of the pressing drive member 8 has a two-step structure consisting of the large-diameter boss 8*b* toward the base end and of the threaded small-diameter boss 8*c* toward the fore-end.

A rotary drive member 14 is externally fitted around the large-diameter boss 8*b* of the pressing drive member 8. The external diameter of the rotary drive member 14 is substantially equal to that of the lock teeth 80 formed on the flange 8*a* of the pressing drive member 8.

On the axial base end face of the rotary drive member 14 there are formed lock teeth 140 capable of mating with the lock teeth 80 of the pressing drive member 8 and projecting toward the axial base end. Each lock tooth 140 of the rotary drive member 14 is of a contour that is substantially coincident with the geometry of a groove formed between the adjacent lock teeth 80 of the pressing drive member 8. In the shown example, the lock teeth 140 of the rotary drive member 14 are each of a generally triangular section that is substantially the same as, but inverted to, that of the lock tooth 80 of the pressing drive member 8.

More concretely, each lock tooth 140 of the rotary drive member 14 is formed with a wind-down press face 140*a* that is shaped into a steeply sloped face. The angle of slope of the steeply sloped face corresponds to that of the wind-down press face 80*a* of the pressing drive member 8. On the other hand, a wind-up press face 140*b* is in the shape of a gently sloped face similar to the wind-up press face 80*b* of the pressing drive member 8.

It is to be noted that the portions of the lock teeth 80 and 140 of the pressing drive member 8 and the rotary drive member 14, respectively, are subjected to quench hardening.

A hand chain wheel (driving wheel) 15 is externally fitted around the outer periphery of the rotary drive member 14. A hand chain 20 is passed around the hand chain wheel 15. The hand chain 20 is pulled to impart a forward or reverse rotational force to the hand chain wheel 15. An engaging portion (a first engaging portion) is formed on the outer periphery of the rotary drive member 14. The engaging portion consists of one or more (three in the shown example) substantially rectangular engaging protuberances 14*a* that protrude radially outwardly in the example illustrated. The inner periphery of the hand chain wheel 15 is formed with an engaged portion (a first engaged portion) corresponding to the engaging portion. The engaged portion consists of one or more engaged recesses 15*a* that are formed correspondingly to the engaging protuberances 14*a* for example. The engaging protuberances 14*a* mesh with the engaged recesses 15*a* for mounting. The mounting is thus made such that any circumferential relative displacement between the rotary drive member 14 and the hand chain wheel 15 is restricted. In addition, the hand chain wheel and the rotary drive member are constructed as separate components. It is therefore possible to facilitate a heat treatment applied to the rotary drive member as well as to facilitate a replacement of the rotary drive member that is prone to wear.

The positioning of the rotary drive member 14 relative to the pressing drive member 8 is effected by screwing a nut 25 onto the threaded portion of the small-diameter boss 8*c* at the fore-end of the pressing drive member 8, by way of a disk-shaped rotation limit member 23 and a belleville spring 24 acting as biasing means.

The rotation limit member 23 has on its inner periphery one or more (three in the shown example) substantially rectangular engagement protuberances 23*a* that protrude radially inwardly. Correspondingly to the engagement protuberances 23*a*, a corresponding number of engagement recesses 8*e* are formed at corresponding positions on the outer periphery of the large-diameter boss 8*b* of the pressing drive member 8. The engagement protuberances 23*a* mesh with the engagement recesses 8*e*. The engagement protrusions 23*a* provide an engaged portion (a second engaged portion) and the engagement recesses 8*e* provide an engaging portion (a second engaging portion). This restricts any circumferential relative displacement of the rotation limit member 23 relative to the pressing drive member 8, while permitting its axial displacement. The thus configured rotation limit member 23 is interposed between the rotary drive member 14 and the belleville spring 24. The intervention of the rotation limit member 23 prevents the belleville spring 24 from rotating together with the rotary drive member 14 and thus blocks any circumferential rotation of the, belleville spring 24 to thereby prevent an excess tightening of the nut 25. This prevents the biasing force of the belleville spring 24 acting as the biasing means from varying in use.

The belleville spring 24 acts to provide a biasing force so as to urge the rotary drive member 14 toward the axial base end (toward the pressing drive member 8) by way of the rotation limit member 23. It will be understood that due to the high positioning rigidity between the members, the construction corresponding to a predetermined limit load can be obtained by screwing the nut 25 up to a certain depth which depends on the belleville spring 24 having predefined diameter and thickness. Any need for the adjustment of the limit load is thus eliminated so that the adjusting efficiency can be improved.

The use of the chain hoist of this embodiment will then be described.

In the chain hoist having the above construction, the nut 25 is screwed onto the threaded portion of the small-diameter boss 8*c* so that the rotation limit member 23 is urged toward the axial base end by the belleville spring 24 acting as the biasing means. Since the rotation limit member 23 is in contact with the rotary drive member 14, the latter is urged toward the pressing drive member 8 by the rotation limit member 23. At that time, the lock teeth 80 of the pressing drive member 8 and the lock teeth 140 of the rotary drive member 14 are in engagement with each other.

In case the load chain 13 passed around the load sheave 3 carries a load smaller than the limit load, when the hand chain wheel 15 is operated to rotate the rotary drive member 14, the rotational force is transmitted via the lock teeth 140 and 80 to the pressing drive member 8, which in turn presses the pressure receive member 7 for rotation, allowing the load to be lifted.

On the contrary, in the event that an overload is suspended, when the rotary drive member 14 is rotated by the hand chain wheel 15, the rotary drive member 14 is pressed back toward the axial fore-end against the biasing force of the belleville spring 24 while simultaneously the wind-up press faces 140*b* of the lock teeth 140 are pushed up along the wind-up press faces 80*b* of the lock teeth 80 of the pressing drive member 8. Then, the lock teeth 140 of the rotary drive member 14 finally climb over the lock teeth 80 of the pressing drive member 8, whereupon the lock teeth 140 are forced into engagement with the next grooves between the lock teeth 80 of the pressing drive member 8 by the biasing force of the belleville spring 24.

In this manner, when in an overload condition the hand chain wheel 15 is rotated in the winding up direction, only the rotary drive member 14 rotates, leaving the pressing drive member 8 immovable, which makes it impossible to impart a forward rotation to the pressing drive member 8 to lift the load. Any overload lifting (winding up) operation is thus prevented.

In addition, by virtue of the construction where in case of such a wind-up operation in an overload condition, the lock teeth 140 of the rotary drive member 14 are allowed to climb over the lock teeth 80 of the pressing drive member 8 for the engagement with the next lock teeth, upon climbing over the lock teeth the rotary drive member 14 can instantaneously be displaced a minute distance in the axial direction for the abutment against the pressing drive member 8 to generate a snap. This snap can serve as a warning sound to warn the operator of the overload condition.

On the other hand, due to the steep slope conferred both on the wind-down press faces 140*a* of the lock teeth 140 of the rotary drive member 14 and on the wind-down press faces 80*a* of the lock teeth 80 of the pressing drive member 8, the lock teeth 140 of the rotary drive member 14 are prevented from climbing over the lock teeth 80 of the pressing drive member 8 in the winding down direction. This means that in spite of the overload condition the rotational force of the rotary drive member 14 can be transmitted in the wind-down direction to the pressing drive member 8. Even in the event that the overload condition is presented due to an additional heavy load in the course of load lifting operation, this allows the pressing drive member 8 to rotate in the wind-down direction, making it possible to compulsorily wind down the load.

Furthermore, when the hand chain wheel 15 is rotated in the wind-up direction in an overload condition, the rotary drive member 14 rotates while compressively deforming the belleville spring 24, allowing a large biasing force to act on the belleville spring 24 and the nut 25. However, by virtue of the interposition of the rotary limit member 23 between the rotary drive member 14 and the belleville spring 24 and of the mating of the engagement protuberances 23*a* of the rotation limit member 23 with the engagement recesses 8*e* of the pressing drive member 8, any rotational force of the rotary drive member 14 imparted to the pressing drive member 8 is not transmitted to the belleville spring 24 and the nut 25. This prevents the nut 25 from being tightened or loosened even when the rotary drive member 23 is rotated in an overload condition, eliminating any risk that the set limit load may vary.

Furthermore, since the lock teeth experience a large frictional force, they may otherwise have to be subjected to a heat treatment such as quench hardening. Nevertheless, due to the construction where the rotary drive member 14 having the lock teeth formed thereon and the hand chain wheel 15 are constructed as separate members such that they engage each other in the circumferential direction, the hand chain wheel 15 can be cast and the rotary drive member 14 can be forged, enabling members having a high strength to be manufactured.

Figure 4:
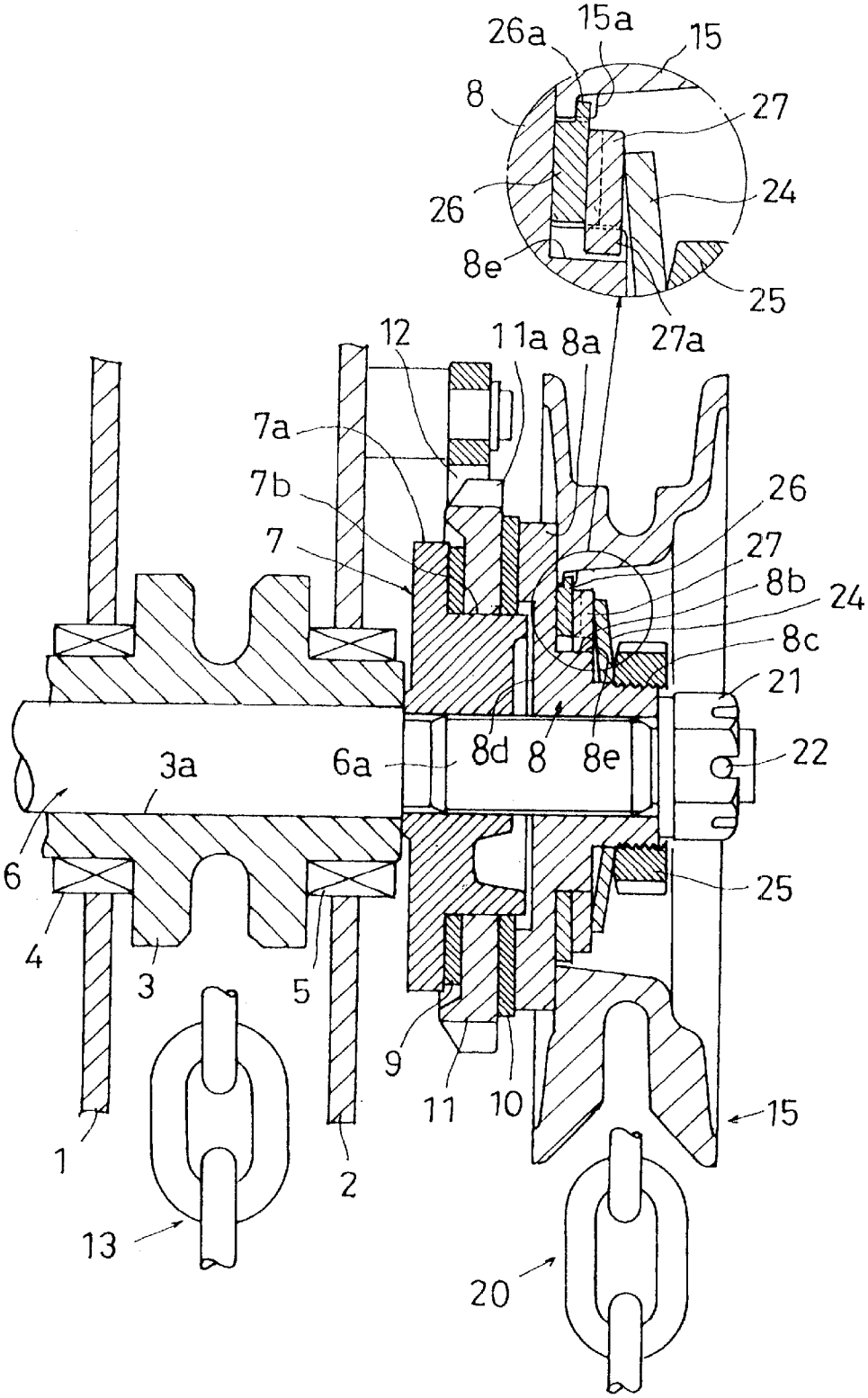
FIG. 4 is a sectional view showing a second embodiment of a chain hoist with an overload prevent device in accordance with the present invention.
Figure 5:
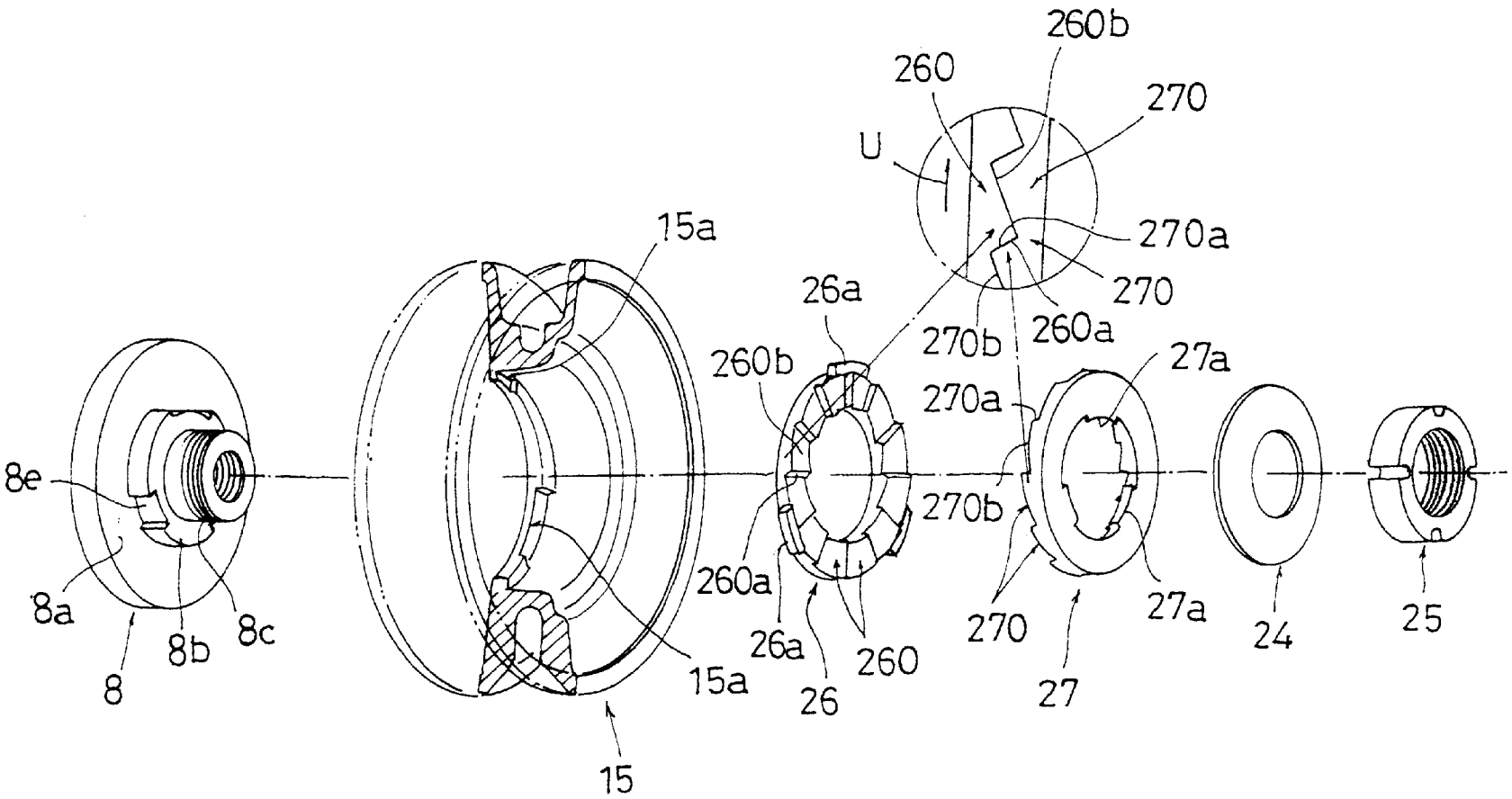
FIG. 5 is an exploded perspective view showing the principal part of the overload prevent device of the chain hoist of the second embodiment shown in FIG. 4.

FIG. 4 is a sectional view of a chain hoist with an overload prevent device in accordance with a second embodiment of the present invention. FIG. 5 is an exploded perspective view of the major part of the overload prevent device of the chain hoist in accordance with this embodiment. This embodiment provides a second aspect of the present invention.

The chain hoist of the second embodiment is also in the form of a chain block, namely a manually operated chain hoist, of which general construction is similar to that of the first embodiment described hereinabove. The difference therebetween will chiefly be described hereinbelow.

This embodiment comprises a lock teeth formation member 27, separate from a rotary drive member 26. Although in the first embodiment the lock teeth 80 and 140 have been formed respectively on the axial fore-end face of the flange 8*a* of the pressing drive member 8 and on the axial base end face of the rotary drive member 14, the second embodiment includes lock teeth 260 and 270 that are formed respectively on the confronting faces of the rotary drive member 26 and the lock teeth formation member 27. These are described below in a specific manner.

With the restricted circumferential displacement relative to the hand chain wheel 15, the rotary drive member 26 is mounted externally around a portion, closer to the axial base end, of the large-diameter boss 8*b* of the pressing drive member 8. More specifically, similar to the rotary drive member 14 of the first embodiment, the rotary drive member 26 has, on its outer periphery, engagement protuberances 26*a* that project radially outwardly and that mesh with the engagement recesses 15*a* formed in the inner periphery of the hand chain wheel 15, for blocking any relative circumferential displacement.

On the other hand, the lock teeth formation member 27 is externally mounted around a portion, closer to the axial fore-end than the rotational drive member 26, of the large-diameter boss 8*b* of the pressing drive member 8. The lock teeth formation member 27 has, on its inner periphery, engagement protuberances 27*a* that protrude radially inwardly and that mesh for mounting with the engagement recesses 8*e* formed in the outer periphery of the large-diameter boss 8*b* of the pressing driving member 8. This restrains the lock teeth formation member 27 from circumferential relative rotations with respect to the pressing driving member 8, but permits any axial displacement.

The positioning of the rotary drive member 26 and the lock teeth formation member 27 is carried out by screwing the nut 25 onto the small-diameter boss 8*c* of the pressing drive member 8 by way of the belleville spring 24. This allows the outer periphery of the belleville spring 24 to abut against the lock teeth formation member 27 so that the latter is urged toward the axial base end with respect to the pressing drive member 8.

It is to be noted that the axial fore-end face of the rotary drive member 26 and the confronting axial base end face of the lock teeth formation member 27 are provided respectively with engagement teeth 260 and 270 that mesh with each other. In the same manner as the first embodiment, the engagement teeth 260 and 270 project in the shape of a substantial triangle.

More specifically, as shown in FIG. 5, each engagement tooth 260 of the rotary drive member 26 includes a wind-down press face 260*a* with a steep slope and a wind-up press face 260*b* with a gentle slope.

On the other hand, each engagement tooth 270 of the engagement tooth profile forming member 27 includes a wind-down press face 270*a* with a steep slope and a wind-up press face 270*b* with a gentle slope.

In the chain hoist of this embodiment, the lock teeth formation member 27 is urged at all times toward the rotary drive member 26 by the belleville spring 24, for the engagement between the lock teeth 260 and 270. Thus, in case of carrying a load smaller than a limit load, when the hand chain wheel 15 is operated to rotate the rotary drive member 26, the rotational force of the rotary drive member 26 is transmitted via the engagement teeth 260 and 270 to the lock teeth formation member 27, whereby the engagement protuberances 27*a* of the lock teeth formation member 27 and the engagement recesses 8*e* of the pressing drive member 8 serve in cooperation to rotate the pressing drive member 8 that is circumferentially locked relative to the lock teeth formation member 27, allowing the load to be lifted.

On the contrary, in the event of carrying an overload, even though the rotary drive member 26 is rotated by the hand chain wheel 15, the lock teeth 260 of the rotary drive member 26 via its gently sloped wind-up press faces 260*b* allow the lock teeth formation member 27 to be pressed back toward the axial fore-end against the biasing force of the belleville spring 24, while simultaneously being pushed up along the wind-up press faces 270*b* of the lock teeth 270 of the lock teeth formation member 27. Then, in the end, the lock teeth 260 of the rotary drive member 26 climb over the lock teeth 270 of the lock teeth formation member 27 to be forced into engagement with the next grooves between the lock teeth 270 by the biasing force of the belleville spring 24.

Thus, even though the hand chain wheel 15 is rotated in the wind-up direction in an overload condition, the rotary drive member 26 will rotate in vain without catching the lock teeth formation member 27, with the result that the lock teeth formation member 27 fails to rotate in the forward direction to lift the load, preventing any overload suspension or winding up. Furthermore, when the lock teeth 260 of the rotary drive member 26 climb over the lock teeth 270 of the lock teeth formation member 27 and engage the next grooves, a snap is generated that can serve as a warning sound to warn the operator of the overload condition.

Moreover, due to the steep slope conferred both on the wind-down press faces 260*a* of the lock teeth 260 of the rotary drive member 26 and on the wind-down press faces 270*a* of the lock teeth 270 of the lock teeth formation member 27, the lock teeth 260 of the rotary drive member 26 are prevented from climbing over the lock teeth 270 of the lock teeth formation member 27 in the winding down direction. This means that in spite of the overload condition the rotational force of the rotary drive member 26 can be transmitted in the wind-down direction to the lock teeth formation member 27. It is therefore possible to compulsorily wind down the load in the overload condition.

In addition, when the hand chain wheel 15 is rotated in the wind-up direction in an overload condition, the rotary drive member 26 rotates while compressively deforming the belleville spring 24, allowing a large biasing force to act on the belleville spring 24 and the nut 25. However, by virtue of the intervention of the lock teeth formation member 27 between the rotary drive member 26 and the belleville spring 24 and of the mating of the engagement protuberances 27*a* of the lock teeth formation member 27 with the engagement recesses 8*e* of the pressing drive member 8, any rotational force of the rotary drive member 26 imparted to the pressing drive member 8 is not transmitted to the belleville spring 24 and the nut 25. This prevents the nut 25 from being tightened or loosened even when the rotary drive member 26 is rotated in an overload condition, eliminating any risk that the set limit load may vary.

Furthermore, since the lock teeth experience a large frictional force, they may otherwise have to be subjected to a heat treatment such as quench hardening. Nevertheless, due to the construction where the rotary drive member 26 having the lock teeth formed thereon and the hand chain wheel 15 are constructed as separate members such that they engage each other in the circumferential direction, the hand chain wheel 15 can be cast and the rotary drive member 26 can be forged, enabling members having a high strength to be manufactured.

It will be appreciated that the chain hoist with the overload prevent device of the present invention could variously be modified in an appropriate manner without being limited to the constructions of the embodiments as set forth hereinabove.

What is claimed is:

1. A chain hoist comprising:

a drive shaft transmitting a rotational force to a load sheave;

a pressure receive member firmly secured to said drive shaft;

a backstop wheel rotating in one direction only relative to said drive shaft;

a pressing drive member adapted to be screwed on said drive shaft in a manner allowing its advance and retreat, with said backstop wheel being sandwiched between said pressing drive member and said pressure receive member;

an axial fore-end defined on said drive shaft adjacent said pressing drive member;

a large-diameter boss projecting from said pressing drive member in the direction toward said axial fore-end;

a small-diameter boss projecting from said large-diameter boss in the direction toward said axial fore-end, said small-diameter boss having threaded grooves formed in its peripheral surface;

a rotary drive member adapted to be fitted rotatably around said large-diameter boss of said pressing drive member, said rotary drive member facing said pressing drive member in said axial direction;

a plurality of lock teeth having a substantially triangular section, said lock teeth being formed on confronting faces of said pressing drive member and said rotary drive member, said lock teeth confronting each other being engaged with each other;

a gently sloped face constituting each of said lock teeth, said gently sloped faces confronting each other being pressed against each other when said rotary drive member is rotated relative to said pressing drive member in the winding up direction;

a steeply sloped face constituting each of said lock teeth, said steeply sloped faces confronting each other when said rotary member is rotated relative to said pressing drive member in the winding down direction;

a first engaging portion formed on the outer periphery of said rotary drive member;

a driving wheel adapted to be fitted around the outer periphery of said rotary drive member, said driving wheel having first engaged portion meshing with said first engaging portion of said rotary drive member;

a second engaging portion formed on said small-diameter boss that protrudes from said rotary drive member in the direction toward the fore-end when said rotary drive member is fitted around said large-diameter boss;

a rotation limit member having a larger external diameter than the internal diameter of said driving wheel, the outer peripheral edge of said rotation limit member serving as a restricting portion for restricting a displacement of said driving wheel in the direction toward said axial fore-end, said rotation limit member having on its inner periphery a second engaged portion that is engaged with said second engaging portion at the fore-end of said large-diameter boss;

biasing means fitted around said small-diameter boss at a position closer to said axial fore-end than said rotation limit member, said biasing means providing a biasing force insufficient to cause said lock teeth of said rotary drive member to climb over said steeply sloped faces of said lock teeth of said pressing drive member when said rotary drive member is rotary in the wind-down direction upon the winding-down operation, said biasing means providing a biasing force sufficient to cause said lock teeth of said rotary drive member to climb over said gently sloped faces of said lock teeth of said pressing drive member when an overload is applied to said rotary drive member upon the winding up operation; and a nut adapted to be screwed into said small-diameter boss, for positioning said biasing means relative to said pressing drive member.

2. A chain hoist comprising:

a drive shaft transmitting a rotational force to a load sheave;

a pressure receive member firmly secured to said drive shaft;

a backstop wheel rotating in one direction only relative to said drive shaft;

a pressing drive member adapted to be screwed on said drive shaft in a manner allowing its advance and retreat, with said backstop wheel being sandwiched between said pressing drive member and said pressure receive member;

an axial fore-end defined on said drive shaft adjacent said pressing drive member;

a large-diameter boss projecting from said pressing drive member in the direction toward said axial fore-end;

a small-diameter boss projecting from said large-diameter boss in the direction toward said axial fore-end, said small-diameter boss having threaded grooves formed in its peripheral surface;

a rotary drive member adapted to be fitted rotatably around said large-diameter boss of said pressing drive member;

a lock teeth formation member adapted to be fitted around said large-diameter boss of said pressing drive member at a position facing the surface, toward said axial fore-end, of said rotary drive member, said lock teeth formation member being mounted thereon in an axially movable but rotationally prohibited manner;

a plurality of lock teeth having a substantially triangular section, said lock teeth being formed on confronting faces of said lock teeth formation member and said rotary drive member, said lock teeth confronting each other being engage d with each other a gently sloped face constituting each of said lock teeth, said gently sloped faces confronting each other being pressed against each other when said rotary drive member is rotated relative to said lock teeth formation member in the winding up direction;

a steeply sloped face constituting each of said lock teeth, said steeply sloped faces confronting each other being pressed against each other when said rotary drive member is rotated relative to said lock teeth formation member in the winding down direction;

an engagement portion formed on the outer periphery of said rotary member;

a driving wheel adapted to be fitted around the outer periphery of said rotary drive member, said driving wheel being engaged between said engagement portion and said pressing drive member so as to restrict a displacement relative to said rotary drive member both in the direction toward said axial-fore end and in the circumferential direction;

biasing means having a larger external diameter than the internal diameter of said lock teeth formation member, the outer peripheral edge of said biasing means acting as a restricting portion for restricting a displacement of said lock teeth formation member in the direction toward said axial fore-end, said biasing member being fitted around said small-diameter boss at a position closer to said axial fore-end, said biasing means providing a biasing force insufficient to cause said lock teeth of said rotary drive member to climb over said steeply sloped faces of said lock teeth of said lock teeth formation member when said rotary drive member is rotated in the wind-down direction upon the winding down operation, said biasing means providing a biasing force sufficient to cause said lock teeth of said rotary drive member to climb over said gently sloped faces of said lock teeth of said lock teeth formation member when an overload is applied to said rotary drive member upon the winding up operation; and a nut adapted to be screwed onto said small-diameter boss, for positioning said biasing means relative to said pressing drive member.

* * * * *